US005676247A

United States Patent [19]

Shioda

[11] Patent Number: 5,676,247

[45] Date of Patent: Oct. 14, 1997

[54] GOLF CLUB COVER FOR GOLF BAG AND METHOD OF STORING

[76] Inventor: Yoshihiko Shioda, 4603 S. Boulevard, Charlotte, N.C. 28209

[21] Appl. No.: 641,496

[22] Filed: May 1, 1996

[51] Int. Cl.[6] ..... A63B 55/00; A63B 57/00

[52] U.S. Cl. ..... 206/315.4; 206/315.3; 150/159

[58] Field of Search ..... 206/315.4, 315.6, 206/315.3; 150/159, 160

[56] References Cited

U.S. PATENT DOCUMENTS

| | | | |
|---|---|---|---|
| 1,774,454 | 8/1930 | Ritchie | 206/315.4 |
| 1,795,880 | 3/1931 | Mullins | 206/315.4 X |
| 1,920,308 | 8/1933 | Hiles | 206/315.6 |
| 2,010,961 | 8/1935 | Reach | 206/315.6 |
| 2,144,791 | 1/1939 | Burton | 206/315.4 |
| 2,552,501 | 5/1951 | Wilkens | 206/315.4 |
| 5,005,623 | 4/1991 | Webster, Jr. | 206/315.4 X |
| 5,490,594 | 2/1996 | Rupe | 206/315.4 |
| 5,507,332 | 4/1996 | McKinnon | 206/315.4 X |

*Primary Examiner*—Sue A. Weaver
*Attorney, Agent, or Firm*—Shefte, Pinckney & Sawyer

[57] ABSTRACT

A golf club cover is disposable about the neck of a golf bag and extendable above the neck of the golf bag to define a sufficient space thereabove to enclose completely and protect any golf clubs contained in the golf bag. A zipper is provided in the cover for opening of the cover when in the extended position. When unzipped, the cover is collapsible from its extended position to wrap around the neck of the golf bag without impeding access to golf clubs in or pockets on the golf bag. Straps with fasteners are attached to the cover for tightly securing the cover when disposed in its collapsed condition around the neck of the golf bag. The cover is provided with fold-lines for controllably and predeterminedly collapsing the cover into an out-of-the-way position. The present invention also involves the folding of the cover down around the neck of the golf bag and securing the cover there, including the folding of a portion of a first surface of the cover down about a first fold-line so that it lies adjacent a second surface; the folding of the second surface down about a second fold-line so that the cover member extends below the neck of the golf bag; and the folding of the second surface about a third fold-line to snugly wrap the cover about the neck of the golf bag.

14 Claims, 9 Drawing Sheets

GOLF CLUB COVER FOR GOLF BAG AND METHOD OF STORING

BACKGROUND OF THE PRESENT INVENTION

The present invention relates generally to golf club covers for golf bags that protect both golf clubs and the interior of golf bags from water during inclement weather conditions, and that protect the golf club heads during transportation, and more particularly, to a golf bag having a cover that can be conveniently stored about the neck of the golf bag when not in use so that it is readily available for protective disposition.

A golf bag normally includes a cover for protecting club heads during transportation, and for protecting clubs and the interior of the bag from water when rain is encountered on a golf course. The conventional cover usually snaps on and off the neck of a golf bag and has a zipper for accessing clubs in the golf bag when the cover is used. The attachment and detachment of the conventional cover, however, is inconvenient and often when playing under weather conditions where rain is suddenly and unexpectedly encountered on a golf course, the cover will have to be found taking up space in one of the many pockets of the golf bag, snapped on, and then extended over the golf clubs and zipped closed. Worse even, a golfer may discover to his detriment that the cover has been left elsewhere and not, in fact, stored in a pocket of the golf bag. Sometimes, to avoid this inconvenience, a golfer may attach but leave unzipped a cover for access to the clubs while attached to the bag. However, this results in cumbersome access to the clubs and, further, the cover often extends loosely down around the golf bag thereby obstructing access to the pockets therein.

Thus, a need exists for a golf club cover which not only protects golf clubs during transport and the interior of the bag from rain whenever encountered, but also permits convenient access to golf clubs or pockets in the golf bag when the cover is left attached to but opened on the golf bag, thereby insuring the available protection of the cover at any time when the need arises.

SUMMARY OF THE PRESENT INVENTION

The present invention generally comprises a golf club cover that can be positioned about the neck of a golf bag in a convenient, out-of-the-way position when not in use so that access to golf clubs and pockets in the golf bag is not obstructed. More specifically, the present invention relates to a golf club bag having a cover which can protect golf clubs and the interior of the golf bag from rain whenever encountered, and in which access to the golf clubs or pockets in the golf bag is not hindered when the cover is secured about the neck of the golf bag in an opened, collapsed position. The present invention further relates to the positioning of a golf club cover when not in use conveniently about a golf bag in an out-of-the-way position.

Briefly, the preferred embodiment of the golf club cover of the present invention serves to cover and protect golf clubs during transport and the interior of the golf bag during inclement weather conditions. The cover is disposable about the neck of a golf bag and extendable above the neck to enclose and protect golf clubs contained in the golf bag. A zipper or the like is provided for convenient access to the golf clubs during play even though the cover is in the extended position. When the zipper is unzipped, the cover is completely collapsible about the neck of the golf bag for uninhibited access to the clubs. Fasteners or other securing means are provided for retaining the cover in the convenient, out-of-the-way position about the neck of the golf bag until further use of the cover arises.

The cover is constructed from a waterproof material and is preferably semi-rigid so that the cover has a tendency to retain its shape when unzipped in the extended position above the neck of a golf bag. Furthermore, the cover is preferably foldable with three fold-lines for efficiently and conveniently collapsing of the cover about the neck of the golf bag for its storage during nonuse. The cover is retained in its out-of-the-way position about the neck of the golf bag preferably by straps that are attached to the cover on opposite sides of the opening formed when the cover is unzipped. The ends of the straps are fastened together to secure the collapsed cover in a taut disposition about the neck of the golf bag.

DETAILED DESCRIPTION OF PREFERRED EMBODIMENT

Figure 1:
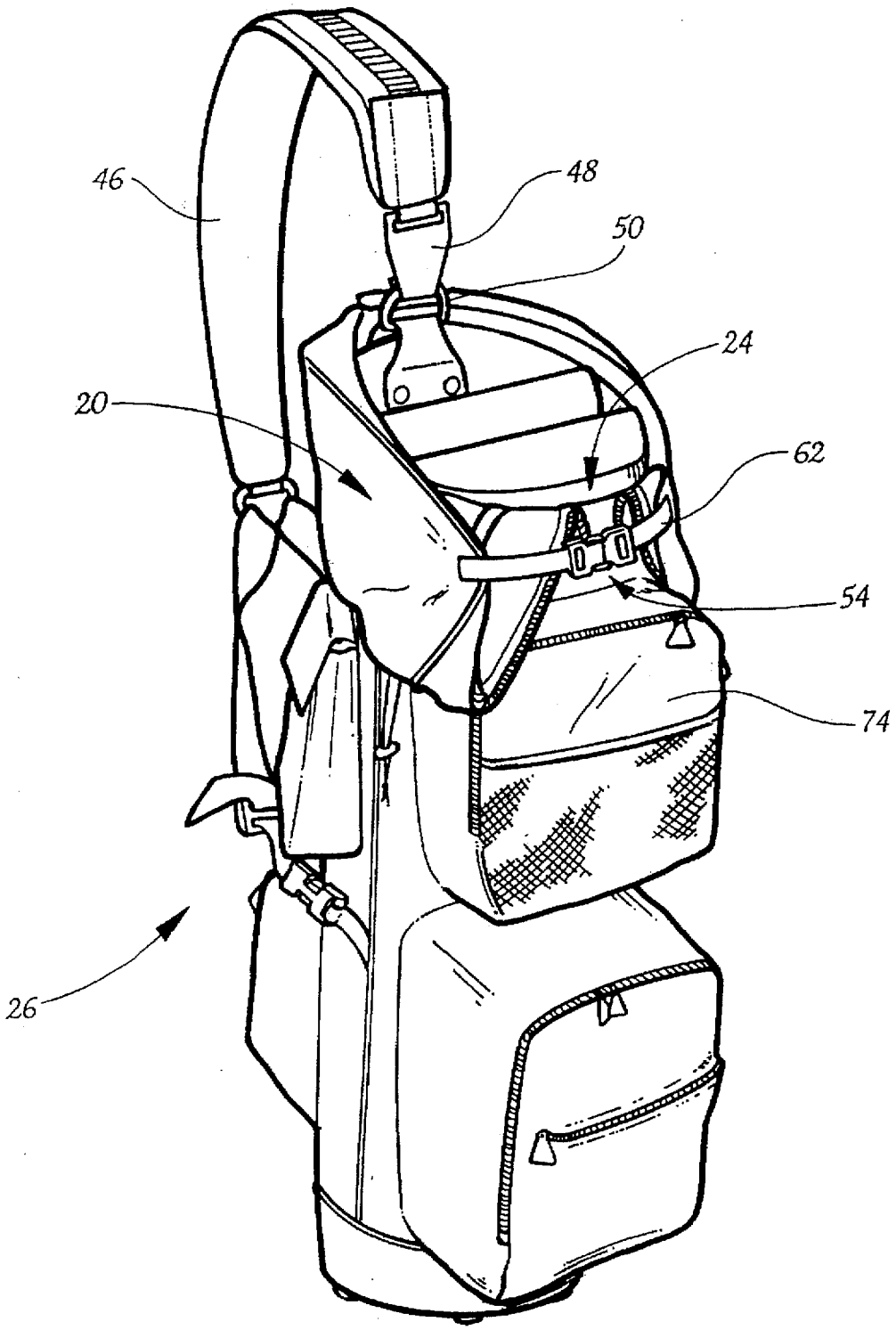
FIG. 1 is a perspective view of the golf club cover of the present invention attached to a golf bag in the opened, foldably retained position.

Referring now to FIGS. 1–11, a golf club cover generally is indicated at 20. An end portion 22 (FIGS. 7–10) of the cover 20 is attachable to or is otherwise disposable adjacent the neck 24 of a golf bag 26 and is of an extent and shape to conform in a tight fit to the conventional shape of the bag neck 24 to which it is attachable, thereby protecting against entry of water into the interior of the golf bag 26. The end portion 22 attaches to the neck 24 of the bag 26 by conventional fastening means, such as snaps 28 (FIGS. 7–10).

While the need for detaching the cover 20 from the golf bag 26 is overcome by the present invention, it is nevertheless preferable that the cover 20 have means 28 for detaching the cover 20 from the golf bag 26. This allows the cover 20 to be used on conventional golf bags which are receptive to the detachable means 28 of the present invention. Furthermore, while the detachable means 28 preferably comprises snaps, other means is contemplated such as zipper means and hook and loop fasteners like Velcro® fasteners. The snaps 28 in the preferred embodiment are fixed on the cover 20 disposable adjacent the neck 24 and attach over studs (not shown) on the neck. Specifically, five pairs of snaps 28 and studs are provided, with each pair equally spaced from another about the end portion 22 of the cover 20 and the neck 24 of the bag 26, respectively. When attached, the studs 28 keep the end portion 22 of the cover 20 in taut engagement with the neck 24, thereby preventing water leakage into the interior of the bag 26 during inclemental weather.

Figure 8:
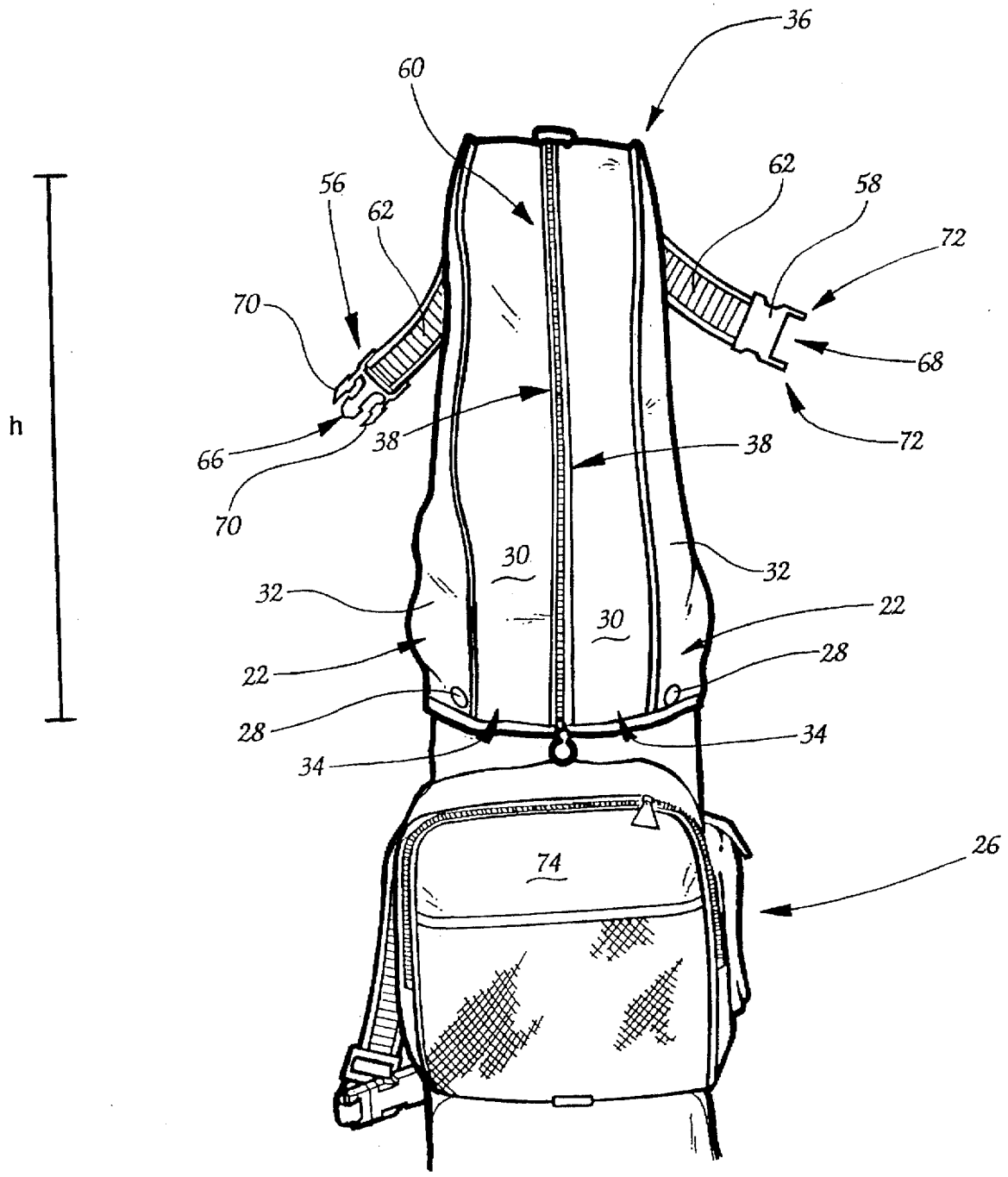
FIG. 8 is a front elevational view of the golf club cover of FIG. 7 in the extended, closed position.
Figure 9:
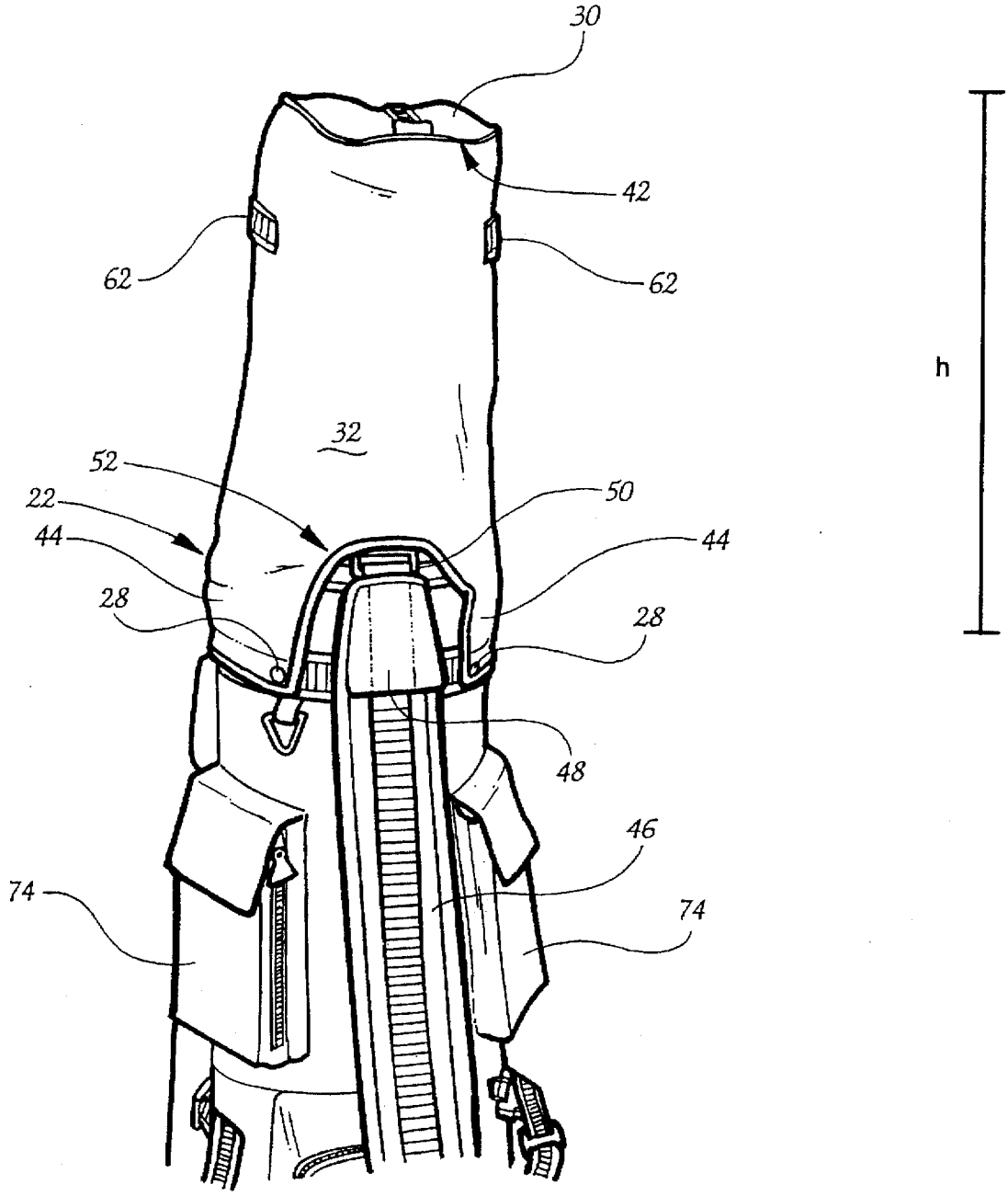
FIG. 9 is a rear elevational view of the golf club cover of FIG. 8.

Returning to a description of the cover 20, it is constructed from a waterproof material and comprises a first surface 30 and a second surface 32. The first surface 30 has a small widthwise end portion 34 disposable adjacent the middle of the from of the neck 24 of the bag 26, as depicted in FIG. 8. For reference purposes herein, the golf bag 26 to which the cover 20 is attached in the figures is vertically disposed, and in this disposition of the bag 26, the first surface 30 of the cover 20 extends vertically away from the neck 24 in a lengthwise direction when the cover 20 is attached and in the extended, closed position. Once the first surface 30 has reached a height h that surpasses the height of any clubs to be covered, the first surface 30 curves to horizontally extend completely over the golf bag 26 and any clubs contained therein (see, e.g., FIG. 8 at 36). The first surface 30 itself comprises two lengthwise extending inner edge portions 38 that form an opening 39 (shown in FIG. 7) for access to the clubs and for opening disposition of the cover 20 for collapsing about the neck 24 of the bag 26, as more fully described below. The two inner edge portions 38 are releasably seemed together in the lengthwise direction by a conventional zipper 40, or alternatively, by fastening means such as buttons, buckles, Velcro® strips and the like. When the cover 20 is in the extended position above the neck 24 of the golf bag 26, the zipper 40 joins the inner edge portions 38 to close the cover 20 in protecting disposition.

The second surface 32 joins with the outer edges of the first surface 30 at seam 42 except for where the first surface 30 is disposable adjacent the neck 24 of the golf bag 26 at end portion 34, as described above. Specifically, the second surface 32 joins with the outer edges of the first surface 30 at seam 42 in extending vertically to the height h which exceeds the height of any clubs contained in the bag 26, and then the second surface 32 continues to join with the outer edges of the first surface 30 at seam 42 as the first surface 30 curves into the horizontal position. When the cover 20 is disposed in the extended position, the joining of the second surface 32 to the first surface 30 appears U-shaped when viewed from above (see, e.g., FIG. 10). Where the second surface 32 does not join with the first surface 30, it engages the entire neck 24 of the bag 26 except for where the first surface 30 is disposed adjacent the neck 24 of the bag 26.

Thus, the first surface 30 is completely surrounded by the second surface 32 and the neck 24 of the bag 26, and the second surface 32 is completely surrounded by the first surface 30 and the neck 24 of the bag 26. Hence, when the zipper 40 is closed and the cover 20 is in use in the extended position above the neck 24, the first and the second surfaces 30,32 completely enclose a space above the golf bag 26 containing the club heads and completely seal the neck 24 of the golf bag 26 from the exterior, thereby protecting the clubs and the interior of the bag. In other words, the first surface includes two extending inner edge portions that extend in L-shape configuration up and over a golf bag, the zipper being attached to the inner edge portions for opening and closing of the cover, and the second surface is U-shaped and extends above the golf bag to join with said first surface to thereby define a sufficient space thereabove to completely enclose and protect golf clubs contained in the golf bag.

Protection from water damage is insured by extending the end portion 22 of the cover 20 a certain extent down the side of the golf bag neck 24 in snug engagement therewith. Preferably, the cover 20 extends approximately two and a half inches below the neck 24; however, the only requirement is that the cover 20 extend a sufficient length so that the cover 20 snugly engages the neck 24 and forms a taut engagement therewith. The end portion 44 of the second surface 32 includes the snaps 28, as discussed in detail above, which fasten the end portion 22 of the cover 20 to the neck 24 of the bag 26.

While the end portion 22 of the cover 20 extends down the golf bag 26 continuously about the neck 24, the golf bag 26 has a shoulder strap 46 that allows the golf bag 26 to be carried over a shoulder. Such a strap 46 is conventionally attached at the neck 24 of the bag 26 by a clip 48 fastened to an eye 50 that is disposed adjacent the neck 24 of the bag 26 in the middle of the back of the neck 24, as depicted for example in FIG. 5. In this situation, the end portion 22 of the cover 20 does not extend down over the eye 50 and the attached strap 46 and clip 48, but rather, the second surface 32 of the cover 24 is constructed with an inverted U-shaped recess 52 that allows the second surface 32 of the cover 20 to extend down around the eye 50, clip 48, and the shoulder strap 46. The U-shaped recess 52, however, does not compromise the protection of the bag 26; the edge of the U-shaped recess 52 still engages the neck 24 of the bag 26 in a snug and tight disposition due to the snaps 28, as is conventionally known.

Figure 2:
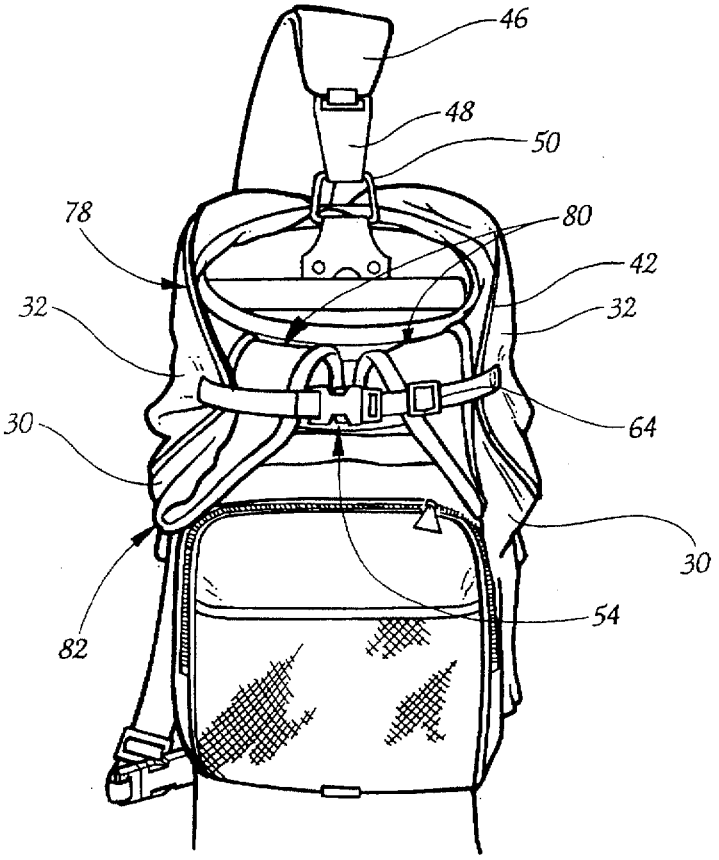
FIG. 2 is front elevational view of the golf club cover of FIG. 1.
Figure 3:
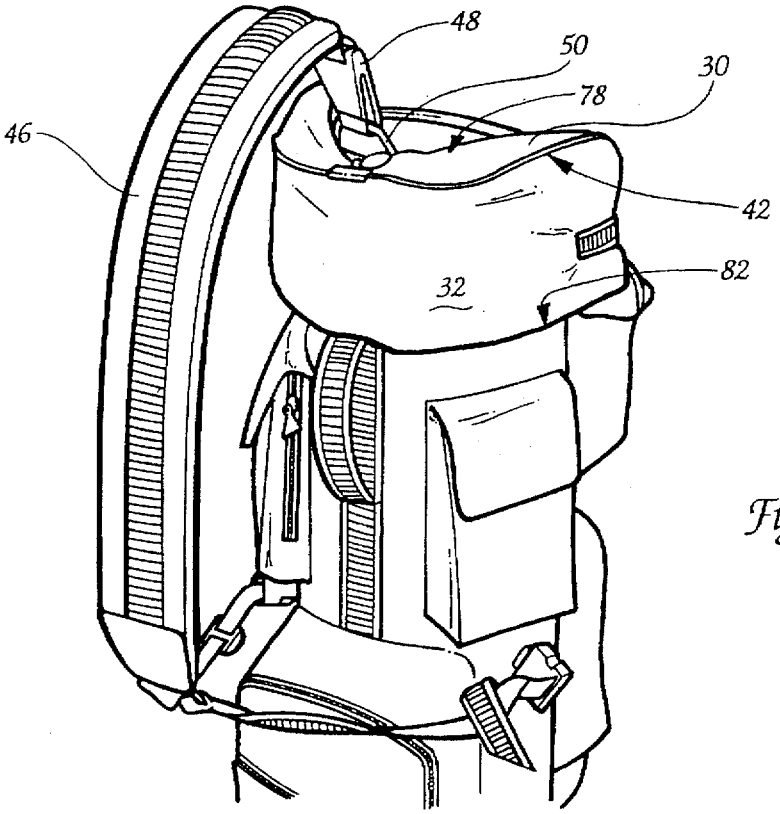
FIG. 3 is a rear perspective view of the golf club cover of FIG. 1.
Figure 4:
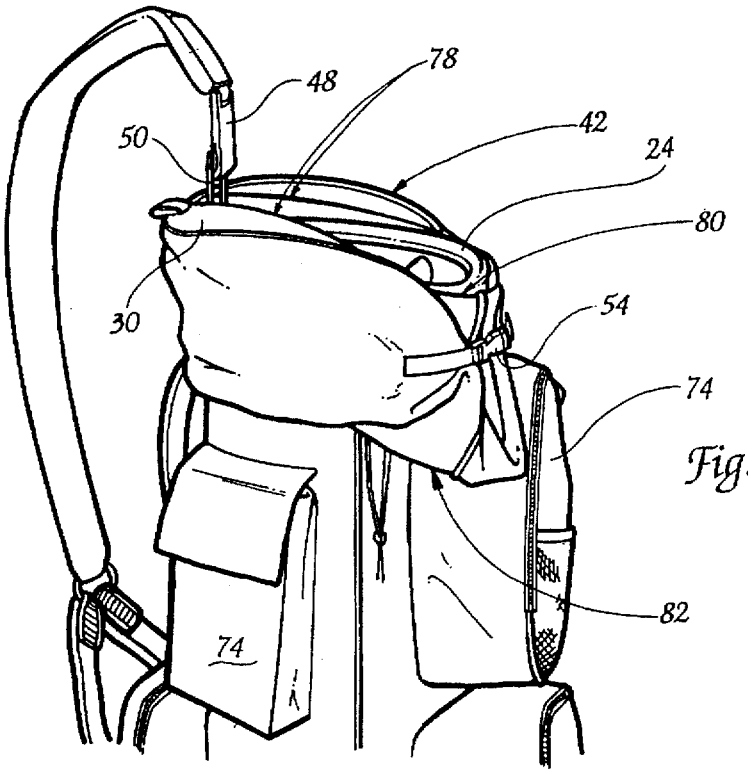
FIG. 4 is a side perspective view of the golf club cover of FIG. 1.
Figure 5:
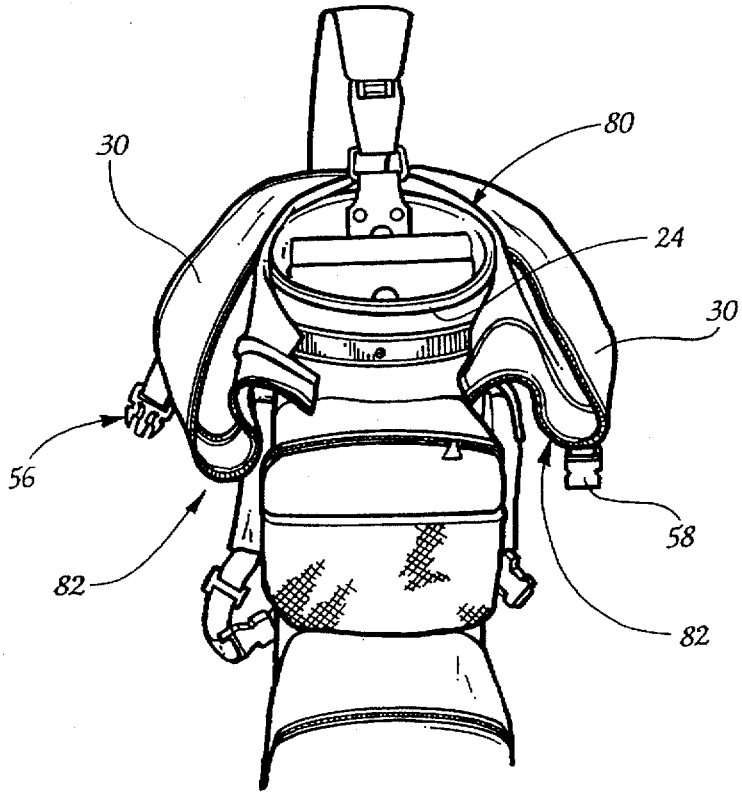
FIG. 5 is a from elevational view of the golf club cover of FIG. 1 in the opened, folded position but unsecured.
Figure 6:
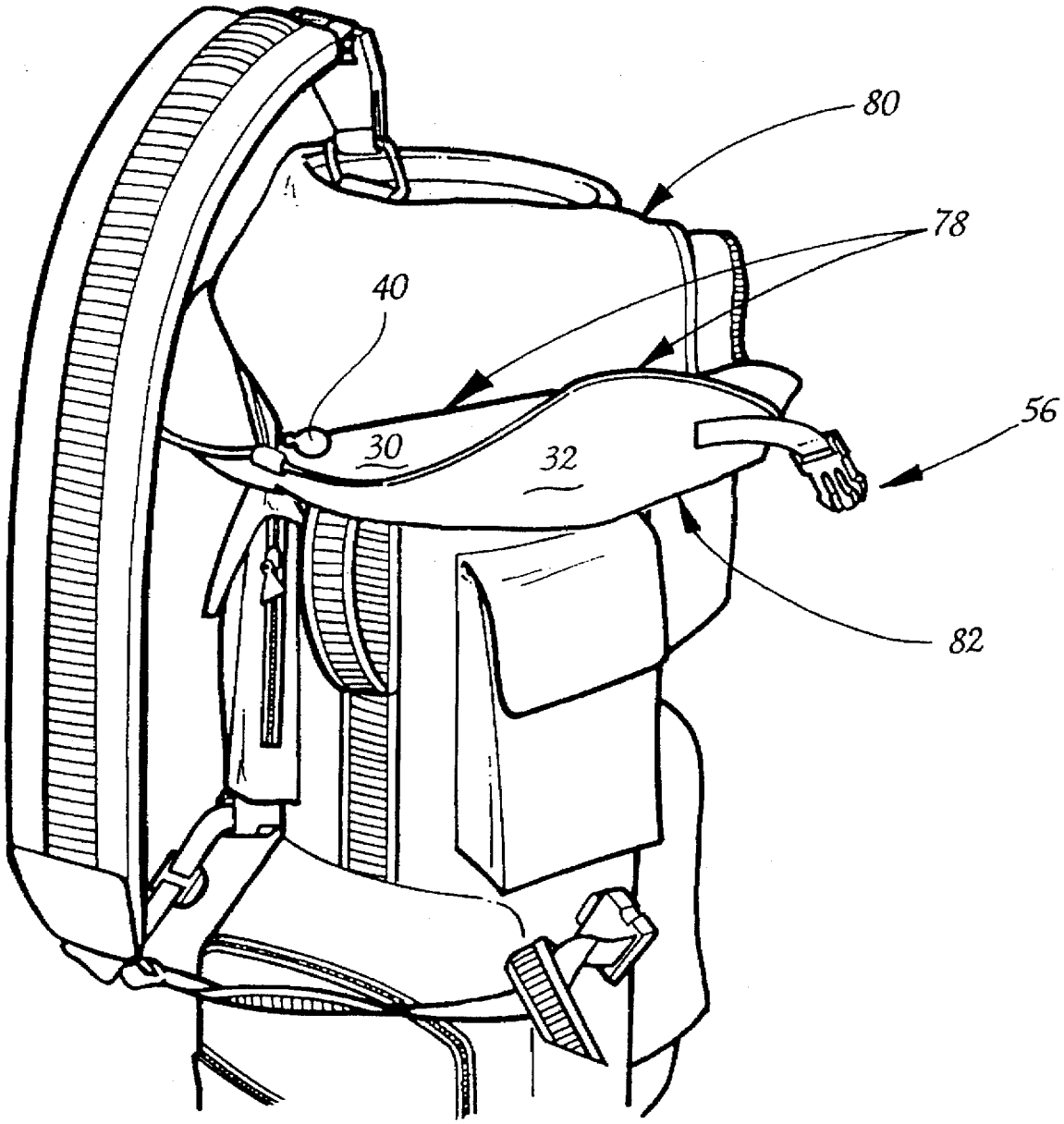
FIG. 6 is a rear perspective view of the golf club cover of FIG. 5.
Figure 7:
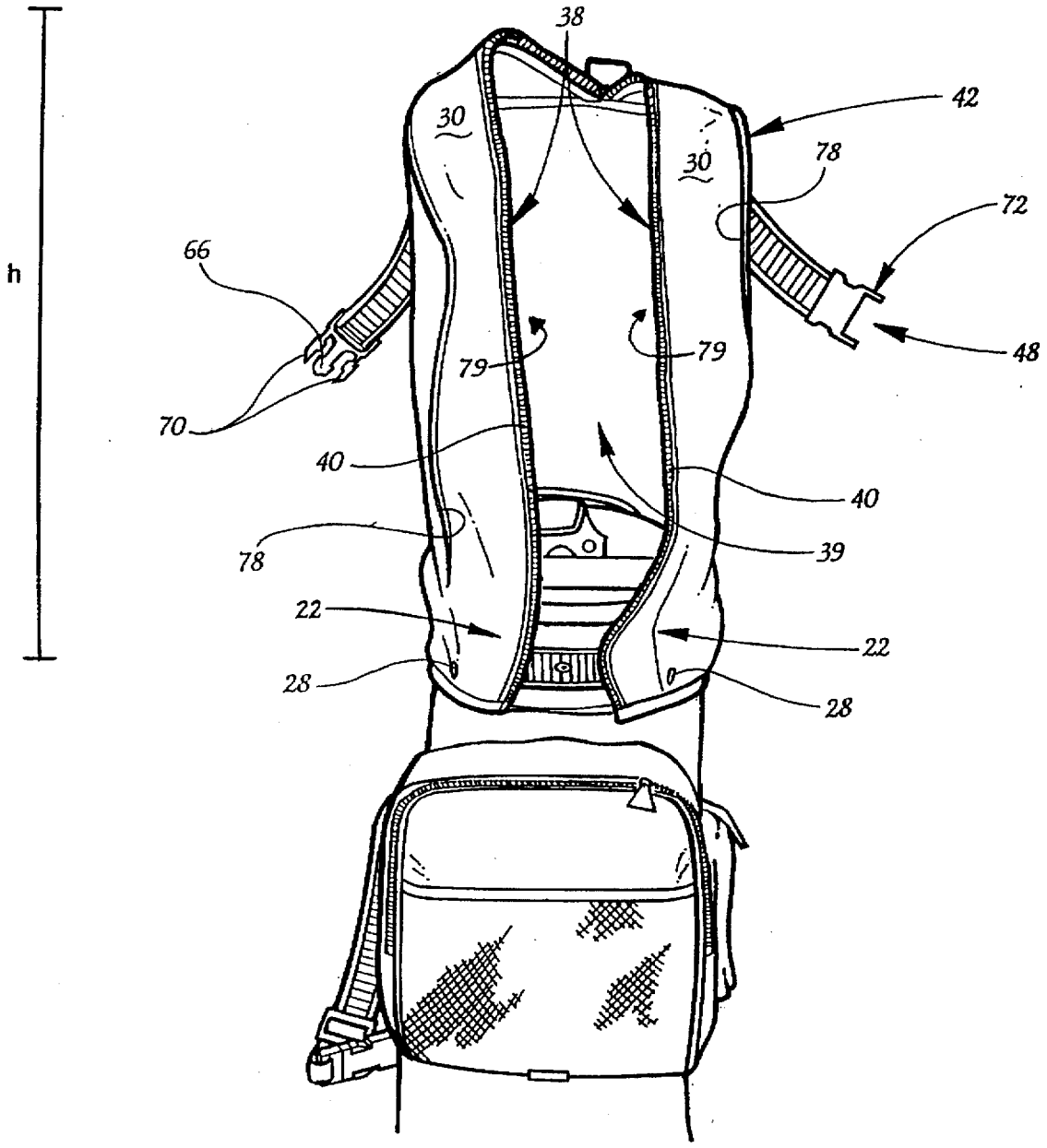
FIG. 7 is a from elevational view of the golf club cover of FIG. 1 in the extended, open position.
Figure 10:
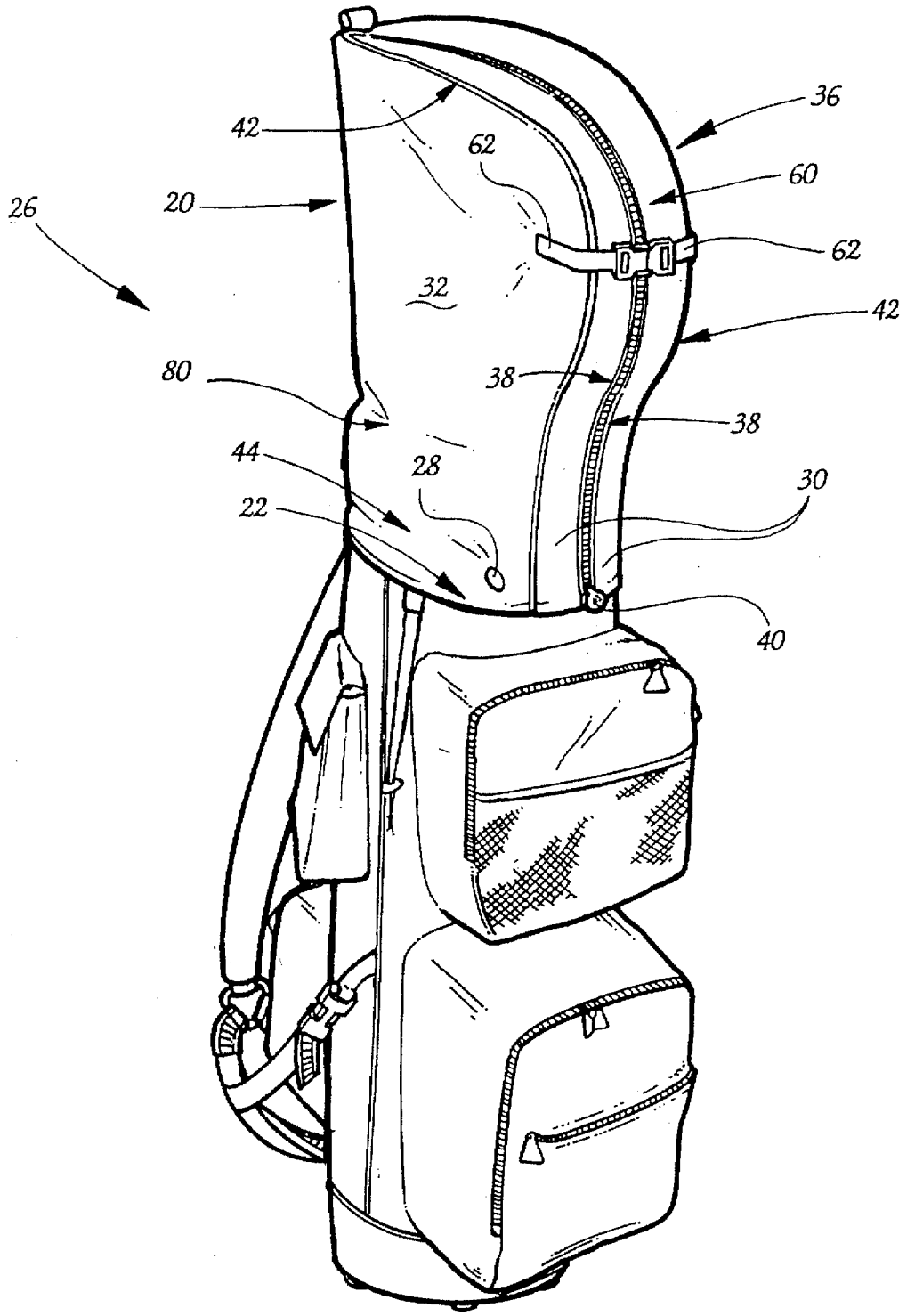
FIG. 10 is a perspective view of the golf club cover of FIG. 1 in the extended, closed position.

The cover includes novel securing means 54 for securing the cover 20 about the neck 24 of the bag 20 when folded down thereabout for convenient storage during nonuse, as more fully explained below. The novel securing means 54 comprises two straps 62 which have complementary fastening components. A strap 62 attaches each end 56,58 to the second surface 32, and each strap 62 preferably has means 64 for adjusting the length of the strap 62 between its respective end 56,58 and the second surface 32, thereby adjusting the tightness of the straps 62 in securing the cover 20 to the neck 24. The fastening components comprise a male end 56 and a female end 58 which, when the male end 56 is inserted into the female end 58, snap into locking engagement. The female end 58 is attached to one of the straps 62, and the male end 56 is attached to the other of the straps 62. In the embodiment disclosed, the female end 58 is attached by a strap 62 to the second surface 32 of the cover 20 and is disposable in a widthwise direction across the upper vertical portion 60 of the first surface 30. The male end 56 is similarly disposed via a strap 62 opposite the female end 58 on the second surface 32 and is disposable in a widthwise direction across the upper vertical portion 60 of the first surface 30 so that both fastening ends 56,58 can interlock together over the first surface 30, as depicted in FIG. 10. When the cover 20 is foldably collapsed about the bag neck 24, the straps are brought together, the fastening ends 56,58 interlock to retain the cover 20 in taut disposition. Specifically, the fastening ends 56,58 extend across the opening 39 formed by the separation of the inner edge portions 38 of surface 30 when the cover 20 is unzipped, as depicted in FIGS. 2 and 3.

The operation of the fasteners 56,58 is as follows: The male end 56 of the securing means 54 has an insert portion 66 that fits into an opening 68 defined by the female end 58. The insert portion 66 includes outward resilient locking means 70 that compresses inward when inserted into the opening 68 of the female end 58, but which snap back outward in two other openings 72 in the female end 58 to lock the insert portion 66 within the opening 68 when the insert portion 66 is fully inserted. With the resilient locking means extending out of the two other openings 72, to disengage the male end 56 from the female end 58, the resilient means 70 must be manually compressed while a withdrawal force is exerted on the male end 56.

Figure 11:
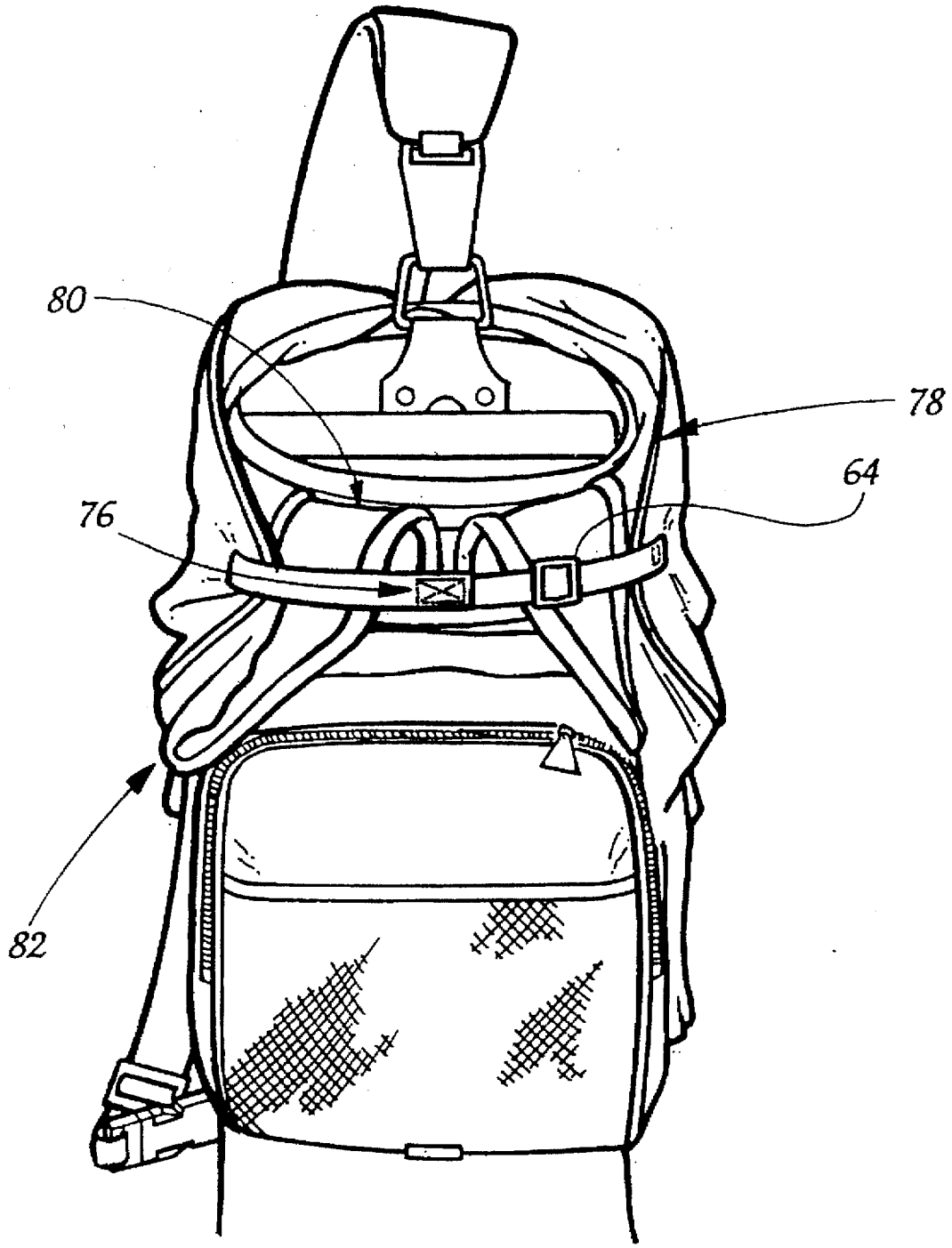
FIG. 11 is a front elevational view of an alternative embodiment of the golf club cover of FIG. 2.

Each end 56,58 of the securing means 54 could alternatively, or together, be attached to the first surface 30 rather than the second surface 32 by straps 62, although this is not the preferable disposition. In any event, the ends 56,58 must be attached to the cover 20 so that, when fastened together, the cover 20 is conveniently wrapped about the neck 24 of the golf bag 26 in an out-of-the-way position so as not to interfere with removal and insertion of golf clubs or inhibit access to the golf bag pockets 74. In an alternative embodiment, the securing means 54 of the present invention comprises hook and loop fasteners 76 attached to the ends of two straps 62, as depicted in FIG. 11. An example of hook and loop fasteners are Velcro® fasteners. Other securing means such as buttons, strings, zipper means or the like is contemplated but not preferred.

With respect to a detailed description of the cover 20, it is preferably semi-rigid but nevertheless foldably collapsible to be positioned about the bag neck 24 in a convenient, out-of-the-way position when not in use. Furthermore, the collapsing of the cover 20 into this position preferably is not random. Rather, the cover 20 is preferably foldable about three novel fold-lines 78,80,82 for novel disposition of the cover 20 in a stored condition while remaining attached to the neck 24 of the bag 26. The novel fold-lines 78,80,82 are provided in the waterproof material of the cover 20 so that the cover 20 essentially folds thrice to reduce its size for an efficient and snug fit about the bag neck 24. The first fold-line 78 runs approximately adjacent the seam 42, i.e., the intersection of the first surface 30 with the second surface 32. Consequently, when the zipper 40 has been fully opened, the first fold-line 78 allows substantially all of the horizontal portion of the first surface 30 to be folded into and adjacent the interior of the second surface 32. The second fold-line 80 runs along the second surface 32 of the cover 20 where it meets the neck 24 of the bag 26 and allows the cover 20 to be folded down about the neck 24 of the bag 26 so that the interior of the second surface 32, except where adjacent the neck 24 of the bag 26, faces outwardly, as does the folded first surface 30, as depicted for example in FIG. 6. Finally, a third fold-line 82 runs through the second surface 32 and allows the second surface 32 to be folded again in on itself in an upward direction. Thus, in the fully folded, collapsed position, (a) part of the second surface 32 is disposed adjacent the golf bag neck 24, (b) the first surface 30 is sandwiched between the interior surface area of the second surface 32, and (c) part of the second surface 32 faces outwardly from the golf bag neck 24. In folding the cover 20 down about the golf bag 26, the clip 48 of the shoulder strap 46 is disengaged from the eye 50. Then the cover 20 is folded down over the eye 50, and then the hook 48 of the shoulder strap 46 is reengaged to the eye 50 so that the shoulder strap 46 extends over the collapsed cover 20. It is contemplated that the cover 20 may be constructed from a flexible material, like nylon for example, that can be rolled up into a zipper pouch extending around the neck 24 of the golf bag 26, similar to roll-up hoods provided on windbreakers and jackets. However, the preferred embodiment of the present invention comprises the semi-rigid cover 20 with fold-lines 78,80,82 so that the cover 20 retains its shape when unzipped in the extended position for limited removal of golf clubs during inclemental weather conditions.

In use, when the zipper 40 is opened to or adjacent the top of the cover 20 and the cover 20 is in the extended position, access to the interior of the bag 24, and specifically to the clubs therein, is achieved. Because the material of the cover 40 is preferably semi-rigid, the cover 20 will retain substantially its extended shape when the zipper 40 is opened from the closed position. Thus, a club can be conveniently removed during inclement weather without the cover 20 immediately collapsing about the neck 24 of the bag 26.

When weather conditions no longer necessitate the use of a cover 20 during play, it conventionally is taken off the golf bag 26. Now, however, due to the present invention, the cover 20 is conveniently folded and stored around the neck 24 of the golf bag 26 by collapsing it entirely about the neck 24 of the golf bag 26 without blocking the opening of the neck 24 and the clubs contained therein. First, the cover 20 in the extended position is fully unzipped by zipper 40. Second, the first surface 30 is folded down about the first fold-line 78 as indicated by arrow 79 in FIG. 7 so that it is adjacent the interior surface area of the second surface 32. Third, the second surface 32 is folded down about the second fold-line 80 so that the cover 20 extends below the neck 24 of the golf bag 26 and the opening in the neck 24 of the golf bag 26 and any clubs therein are freely accessible. Alternatively, steps two and three could be interchanged. Fourth, the upper portion of the second surface 32 is then folded about the third fold-line 82 so that pockets 74 in the golf bag 26 are freely accessible and the cover 20 wraps around the neck 24 of the golf bag 26 in a convenient and novel out-of-the-way position. Fifth and finally, the straps 62 are extended across the opening 39 and the male and female ends 56,58 of the securing means 54 are locked into engagement to retain the cover 20 in tight disposition about the neck 24 of the golf bag 26. So folded, the cover 20 can be tightly fitted about the neck 24 of the bag 26 out of the way of any pockets 74 and retained in such position by the novel securing means 54, which can be fastened to keep taut the cover 20 around the neck 24 of the bag 26 so that parts of the cover 20 do not hang down and obstruct pockets 74 in the golf bag 26 during continual play. Furthermore, the cover's novel securing means 54 sufficiently retains the cover 20 conveniently about the neck 24 in taut disposition so that the cover 20 can remain about the neck 24 even after play, i.e., during transport to and from a golf course and storage of the bag, if the cover is not used.

Conventionally, a golf club cover is detachable from a golf bag for storage when not in use. While the present invention eliminates the necessity for making covers detachable, since the covers 20 can now be conveniently stored about the necks of golf bags 26, the detachable feature is nevertheless an added convenience because it allows covers 20 on golf bags of the present invention to be used interchangeably on conventional golf bags.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What I claim is:

1. An improved removable golf club cover for a golf bag that is positionable in an attached, collapsed condition about a neck of the golf bag in a convenient, out-of-the-way disposition so that access to golf clubs in and the pockets on the golf bag is not hindered, comprising:

a semi-rigid cover member removably attached about an area of the neck of the golf bag and extendable above the neck of the golf bag in an extended position to define a sufficient space thereabove to completely enclose and protect golf clubs contained in the golf bag, means for opening said cover member for accessing the golf clubs in the golf bag when in said extended position thereabove, said cover member including at least one predetermined fold-line for predetermined and controlled folding of said cover member from its extended position to a collapsed position about said attachment area of the neck of the golf bag when said opening means is open, and means attached to said cover member for securing said cover member in said collapsed position about the neck of the golf bag so that said cover member does not obstruct access to golf clubs in or pockets on the golf bag.

2. A golf club cover according to claim 1, further comprising means for attaching and detaching said cover member from a golf bag.

3. A golf club cover according to claim 1, wherein said at least one predetermined fold-line comprises three fold-lines.

4. A golf club cover according to claim 1, wherein said cover member comprises two surfaces and said at least one predetermined fold-line comprises three fold-lines.

5. A golf club cover according to claim 4, wherein a first surface of said two surfaces includes two extending inner edge portions that extend in L-shape configuration up and over a golf bag, said opening means being attached to said inner edge portions for opening of said cover member, and said second surface is U-shaped and extends above the golf bag to join with said first surface thereby defining a sufficient space thereabove to completely enclose and protect golf clubs contained in the golf bag.

6. An improved removable golf club cover for a golf bag that is positionable in an attached, collapsed condition about a neck of a golf bag in a convenient, out-of-the-way disposition so that access to golf clubs in and the pockets on the golf bag is not hindered, comprising:

a cover member removably attached about an area of the neck of the golf bag and extendable above the neck of the golf bag in an extended position to define a sufficient space thereabove to completely enclose and protect golf clubs contained in the golf bag, means for opening said cover member for accessing the golf clubs in the golf bag when in said extended position thereabove, said cover member including a predetermined fold-line for predetermined and controlled folding of said cover member from its extended position to a collapsed position about said attachment area of the neck of the golf bag when said opening means is open, and means attached to said cover member for securing said cover member in said collapsed position about the neck of the golf bag so that said cover member does not obstruct access to golf clubs in or pockets on the golf bag, said securing means extending across said opening in said cover member defined by said opening means when said opening means is open.

7. An improved golf bag comprising:

a golf bag for containing golf clubs therein and having pockets thereon, a semi-rigid golf club cover removably attached to an area of a neck of said golf bag and extendable above said neck to an extended position to define a sufficient space thereabove to completely enclose and protect golf clubs contained in said golf bag, means attached to said cover for opening said cover for accessing golf clubs in said golf bag when said cover is in said extended position, said cover including at least one predetermined fold-line for predetermined and controlled folding of said cover member from said extended position to a collapsed position about said attachment area of said neck of said golf bag when said opening means is open, and means attached to said cover for securing said cover in said collapsed position about said neck of said golf bag so that said cover does not obstruct access to golf clubs in or said pockets on said golf bag.

8. A golf bag according to claim 7, wherein said securing means extends across the opening in said cover defined by said opening means when said opening means is open.

9. A golf bag according to claim 8, wherein said securing means comprises straps having complementary detachable fastening components.

10. A golf bag according to claim 9, wherein said securing means includes two straps.

11. A golf bag according to claim 7, wherein said cover comprises two surfaces and said at least one predetermined fold-line comprises three fold-lines.

12. A method for storing an openable and collapsible golf club cover on a golf bag comprising the steps of:

attaching a semi-rigid cover member to an area of a neck of a golf bag, opening the cover member when in an extended position above the golf bag enclosing and protecting golf clubs contained in the golf bag, folding the cover member down about the attachment area of the neck of the golf bag about at least one predetermined fold-line in the cover member, and securing the collapsed cover member to the neck of the golf bag with straps attached to the cover member so that the cover member does not obstruct access to golf clubs in or pockets on the golf bag.

13. The method of claim 12, wherein the cover member comprises two surfaces and said at least one predetermined fold-line comprises three fold-lines, and the step of folding the cover member down about the attachment location of the neck of the golf bag comprises:

folding a portion of the first surface down about a first fold-line so that it is adjacent the second surface, folding the second surface down about a second fold-line so that the cover member extends below the neck of the golf bag and the neck of the golf bag and golf clubs therein are freely accessible, and folding the second surface about a third fold-line to snugly wrap the cover member about the neck of the golf bag in a convenient, out-of-the-way position so that golf clubs in and pockets on the golf bag are freely accessible.

14. The method of claim 13, wherein the step of securing the collapsed cover member includes extending the straps across an opening formed when the cover member is opened and fastening in detachable engagement complimentary fastening components that are attached to the ends of the straps.

* * * * *

UNITED STATES PATENT AND TRADEMARK OFFICE

CERTIFICATE OF CORRECTION

PATENT NO. : 5,676,247

DATED : October 14, 1997

INVENTOR(S) : Yoshihiko Shioda

It is certified that error appears in the above-identified patent and that said Letters Paten is hereby corrected as shown below:

Column 2, line 23, after "is" insert - - a - -

Column 2, line 29, delete "from" and insert - - front - -

Column 2, line 34, delete "from" and insert - - front - -

Column 2, line 45, after "OF" insert - - THE - -

Column 3, lines 8 and 9, delete "inclemental" and insert - - inclement - -

Column 3, line 14, delete "from" and insert - - front - -

Column 3, line 29, delete "seemed" and insert - - seamed - -

Column 4, line 31, delete "the bag 20" and insert - - the bag 26 - -

Column 5, line 67, delete "inclemental" and insert - - inclement - -

UNITED STATES PATENT AND TRADEMARK OFFICE

CERTIFICATE OF CORRECTION

PATENT NO. : 5,676,247
DATED : October 14, 1997
INVENTOR(S) : Yoshihiko Shioda

It is certified that error appears in the above-identified patent and that said Letters Patent is hereby corrected as shown below:

Column 6, line 5, delete "40" and insert --20--

Signed and Sealed this

Ninth Day of February, 1999

*Attest:*

*Attesting Officer*

*Acting Commissioner of Patents and Trademarks*